US008866711B2

(12) United States Patent
Yamashita

(10) Patent No.: US 8,866,711 B2
(45) Date of Patent: Oct. 21, 2014

(54) DRIVING METHOD INCLUDING REFRESHING A PIXEL MEMORY AND LIQUID CRYSTAL DISPLAY DEVICE UTILIZING THE SAME

(75) Inventor: Keitaro Yamashita, Kobe (JP)

(73) Assignee: Innolux Corporation, Chu-Nan (TW)

( * ) Notice: Subject to any disclaimer, the term of this patent is extended or adjusted under 35 U.S.C. 154(b) by 465 days.

(21) Appl. No.: 12/716,156

(22) Filed: Mar. 2, 2010

(65) Prior Publication Data

US 2010/0238154 A1 Sep. 23, 2010

(30) Foreign Application Priority Data

Mar. 19, 2009 (JP) ..... 2009-068142

(51) Int. Cl.
*G09G 3/36* (2006.01)

(52) U.S. Cl.
CPC ..... *G09G 3/3614* (2013.01); *G09G 3/3618* (2013.01); *G09G 2330/021* (2013.01); *G09G 3/3648* (2013.01); *G09G 2300/0842* (2013.01)
USPC ..... 345/87; 345/89; 345/90; 345/98; 345/204; 345/211

(58) Field of Classification Search
CPC ..... G09G 3/3614
USPC ..... 345/87–102, 204–215
See application file for complete search history.

(56) References Cited

U.S. PATENT DOCUMENTS

| | | | | |
|---|---|---|---|---|
| 3,830,970 | A * | 8/1974 | Hurley et al. | 348/164 |
| 2002/0036625 | A1* | 3/2002 | Nakamura | 345/204 |
| 2002/0113763 | A1* | 8/2002 | Koyama | 345/87 |
| 2002/0180675 | A1* | 12/2002 | Tobita et al. | 345/87 |
| 2005/0068279 | A1* | 3/2005 | Hirota et al. | 345/87 |

OTHER PUBLICATIONS

"JEDEC DDR SDRAM Specification", dated Mar. 2003, attached here as JEDEC DDR Standard.pdf.*

* cited by examiner

*Primary Examiner* — Alexander S Beck
*Assistant Examiner* — Charles Zheng
(74) *Attorney, Agent, or Firm* — Liu & Liu

(57) ABSTRACT

A liquid crystal display device and a driving method thereof capable of reducing flicker are provided. During a predetermined time period, two continuous inversion operations to pixel voltages and common voltages are repeatedly performed with a timing interval in which the liquid crystal component does not react to changes. After the predetermined time period, the pixel voltages and common voltages are performed by a single inversion operation such that they are phase inverted. Then, the pixel voltages and common voltages are repeatedly performed during the predetermined period by two continuous inversion operations with the timing interval in which the liquid crystal component does not react to changes.

10 Claims, 8 Drawing Sheets

DRIVING METHOD INCLUDING REFRESHING A PIXEL MEMORY AND LIQUID CRYSTAL DISPLAY DEVICE UTILIZING THE SAME

CROSS REFERENCE TO RELATED APPLICATIONS

This Application claims priority of Japanese Patent Application No. 2009-068142, filed on Mar. 19, 2009, the entirety of which is incorporated by reference herein.

BACKGROUND OF THE INVENTION

1. Field of the Invention

The invention relates to a driving method and a liquid crystal display device to restrain flickers.

2. Description of the Related Art

A liquid crystal display device comprising thin film transistors (TFTs) is an active-matrix liquid crystal display device. Each of the TFTs serves as a switching element and is disposed in each pixel. The switching element transmits a signal voltage (e.g. image signal voltage, and comprehensive voltage) to a pixel electrode. Thus, crosstalk does not occur between pixels and the liquid crystal display device achieves high resolution and is capable of displaying different color-depths.

When the liquid crystal display device is employed in an electronic device, if the electronic device utilizes battery power, power consumption of the liquid crystal display device becomes an important factor. Meanwhile, the electronic device may be a mobile data terminal apparatus. Conventional methods (e.g. Japanese Patent Application No. 2004-536347 and 2006-523323) design pixels to have a storing function.

In a liquid crystal display device, which is a dynamic memory type, a storing unit (e.g. dynamic random access memory (DRAM)) is disposed in an output side of each TFT. Each TFT is disposed between an intersection of a source bus line and a gate bus line. The storing unit stores display data such that the stored display data can be displayed in the liquid crystal display device.

In the dynamic memory type, the storing unit is required to be periodically refreshed to maintain the stored data in the storing unit. Particularly, the storing function is embodied according to poly-si semiconductor. Current leakage is increased such that visible flicker.

Thus, to restrain flicker, the periodic refreshing period may be reduced. However, reduction in the periodic refreshing period causes that the writing actions of pixels and peripheral circuits and power consumption are increased. In other words, when power consumption is reduced, the flicker is increased. Similarly, when the flicker is reduced, power consumption is increased. Thus, a liquid crystal display device having low power consumption and is capable of restraining flicker is desired.

BRIEF SUMMARY OF THE INVENTION

An exemplary embodiment of a driving method for a liquid crystal display device is provided. During a predetermined time period, a first refreshing action is executed for a memory. The first refreshing action repeatedly refreshes the memory by an even amount of times with a timing interval in which liquid crystal component does not react to changes. After the predetermined time period, a second refreshing action is executed. The second refreshing action refreshes the memory by an odd amount of times. The first and the second refreshing actions are repeatedly and alternately executed.

An exemplary embodiment of a driving method for a switching element to transmit voltage to a liquid crystal component is provided. When the switching element is turned off, the memory stores the voltage transmitted to the liquid crystal component for controlling optical transmittance or reflectance of the liquid crystal component. During a predetermined time period, a first refreshing action is executed for the memory. The first refreshing action repeatedly refreshes the memory by an even amount of times with a timing interval in which the liquid crystal component does not react to changes. After the predetermined time period, a second refreshing action is executed. The second refreshing action refreshes the memory by an odd amount of times. The first and the second refreshing actions are repeatedly and alternately executed.

In the driving method, the predetermined time period is longer than the time period for executing the second refreshing action. During the predetermined time period, the changing between colors is hardly discriminated and image sticking does not be occurred in the liquid crystal display device.

An exemplary embodiment of a liquid crystal display device utilizing a switching element to transmit voltage to a liquid crystal component is provided. When the switching element is turned off, the memory stores the voltage transmitted to the liquid crystal component to control optical transmittance or reflectance of the liquid crystal component. During a predetermined time period, a first refreshing action is executed for the memory. The first refreshing action repeatedly refreshes the memory by an even amount of times with a timing interval in which the liquid crystal component does not react to changes. After the predetermined time period, a second refreshing action is executed. The second refreshing action refreshes the memory by an odd amount of times. The first and the second refreshing actions are repeatedly and alternately executed.

In the liquid crystal display device, the predetermined time period is longer than the time period for executing the second refreshing action. During the predetermined time period, the changing between colors is hardly discriminated and image sticking does not be occurred in the liquid crystal display device. Optical characteristics (e.g. optical transmittance or reflectance) of the liquid crystal component barely changes during the predetermined time period of the liquid crystal display device.

Meanwhile, during the second refreshing action, the optical characteristics of the liquid crystal component are slightly changed due to feed though effect. Additionally, the changed optical characteristics of the liquid crystal component are maintained during the predetermined time period.

The first and the second refreshing actions are repeatedly and alternately executed. When the liquid crystal display device displays the same image (e.g. white), changes in the optical characteristics of the liquid crystal component is found during execution of the second refreshing action.

Changes in the optical characteristics of the liquid crystal component generate flickers. However, if the switching frequency between the first and the second refreshing actions is less than 1 Hz, flickers during the second refreshing action would hardly be noticed by viewers.

The refreshing frequency of the memory can be reduced such that the liquid crystal display device has low power consumption. The memory stores the voltage of the liquid crystal component.

Further, since the optical characteristics (e.g. optical transmittance or reflectance) of the liquid crystal component do not be changed, when the memory is refreshed, the flickers are restrained.

When the same color (e.g. white) is displayed for a long period of time (e.g. longer than 1 second), the phases of the pixel voltage and the common voltage are inverted and image sticking is avoided due to the changing between colors would hardly be noticed by viewers.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
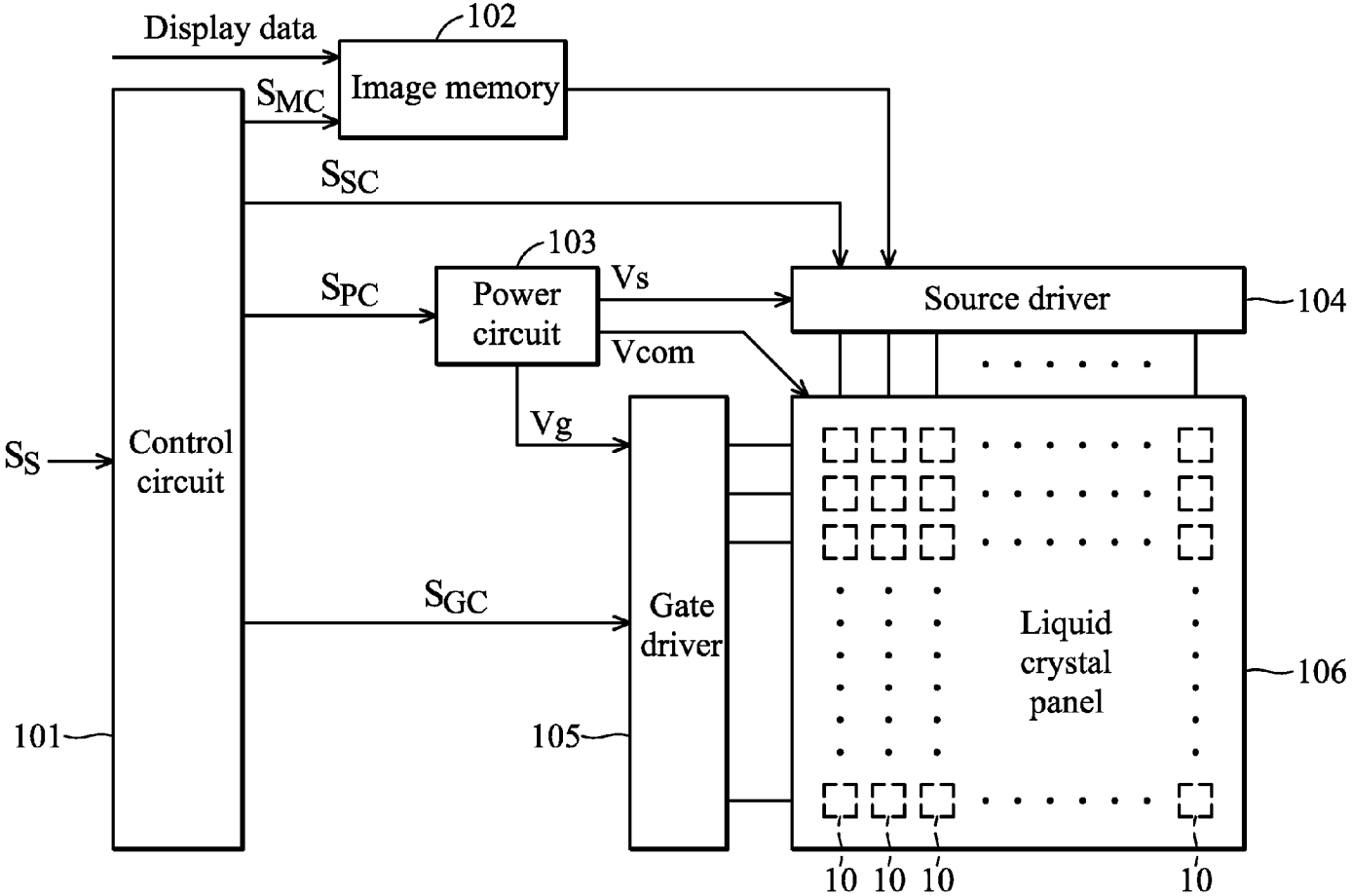
FIG. 1 is a schematic diagram of an exemplary embodiment of a liquid crystal display device.

FIG. 1 is a schematic diagram of an exemplary embodiment of a liquid crystal display device. The liquid crystal display device comprises a control circuit 101, an image memory 102, a power circuit 103, a source driver 104, a gate driver 105, a liquid crystal panel 106, and a reflective plate (not shown). The liquid crystal display device is a reflective liquid crystal display device utilizing the reflection of external light to display image.

The control circuit 101 generates a memory control signal $S_{MC}$, a power control signal $S_{PC}$, a source control signal $S_{SC}$, and a gate control signal $S_{GC}$ according to a synchronous signal $S_S$. The memory control signal $S_{MC}$ is provided to the image memory 102. The power control signal $S_{PC}$ is provided to the power circuit 103. The source control signal $S_{SC}$ is provided to the source driver 104. The gate control signal $S_{GC}$ is provided to the gate driver 105.

The image memory 102 provisionally stores display data. The display data and the memory control signal $S_{MC}$ are synchronous. To display image on the liquid crystal panel 106, the image memory 102 outputs the display data to the source driver 104 according to the memory control signal $S_{MC}$. Further, the image memory 102 can be integrated with the control circuit 101. Accordingly, the image memory 102 operates in the control circuit 101.

In this embodiment, a central processing unit (CPU) disposed in a mobile phone or mobile game machine or a control integrated circuit (IC) for a liquid crystal display (LCD) is capable of providing the synchronous signal $S_S$ and the display data. In other embodiments, when a cathode ray tube (CRT) provides analog signals and the analog signals are transformed into a digital format, the transformed signals can serve as the synchronous signal $S_S$ and the display data. The control circuit 101 can directly capture data stored in a video RAM of a personal computer and the captured data can serve as the synchronous signal $S_S$ and the display data.

The power circuit 103 generates driving voltages Vs, Vg and a common voltage Vcom according to the power control signal $S_{PC}$. The driving voltages Vs, Vg and the common voltage Vcom are synchronized with the power control signal $S_{PC}$. The driving voltage Vs is provided to the source driver 104. The driving voltage Vg is provided to the gate driver 105. The common voltage Vcom is provided to common electrodes of the liquid crystal panel 106.

Figure 2:
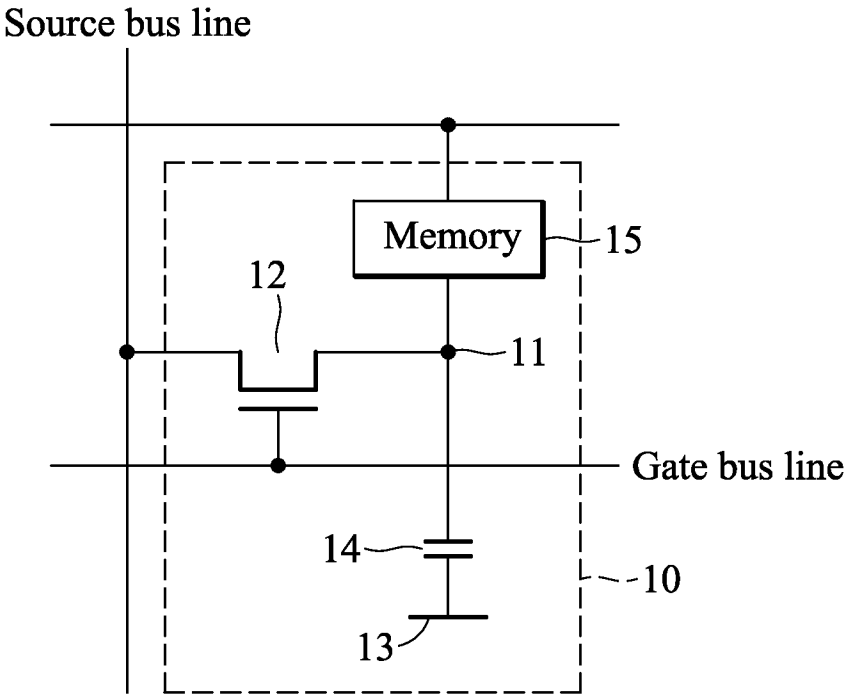
FIG. 2 is a schematic diagram of an exemplary embodiment of a pixel circuit.

The gate driver 105 generates scan voltages according to the gate control signal $S_{GC}$. The scan voltages are synchronized with the gate control signal $S_{GC}$. Each scan voltage controls a switching element (as shown in FIG. 2) to turn on or off. The gate driver 105 transmits the scan voltages to the scan lines of the liquid crystal panel 106.

The source driver 104 captures image data output from the image memory 102 according to the source control signal $S_{SC}$. The image data can be synchronized with the source control signal $S_{SC}$. The source driver 104 has a function, which transmits the image data to the data lines of the liquid crystal panel 106. The source driver 104 has another function, which transmits an external voltage to the data lines when the image data does not synchronize with the source control signal $S_{SC}$.

The liquid crystal panel 106 is a substrate for disposing a plurality of pixel circuits 10 and common electrodes 13 (as shown in FIG. 2). The common electrodes 13 can be referred to as facing electrodes. A liquid crystal component 14 is disposed between the pixel circuits 10 and the common electrodes 13. The structure of one pixel circuit 10 is shown in FIG. 2. The pixel circuit 10 comprises a pixel electrode 11 and a switching element 12. When the switching element 12 is turned on, the data voltage can be transmitted to the pixel electrode 11. When the switching element 12 is turned off, the data voltage can be stored in the memory 15 (e.g. DRAM) for controlling optical transmittance or reflectance of the liquid crystal component.

FIG. 2 is a schematic diagram of an exemplary embodiment of a pixel circuit. The pixel circuit 10 comprises a switching element 12 to determine whether to transmit voltage to the pixel electrode 11. A thin film transistor (TFT) can serve as the switching element 12. When the switching element 12 is turned on, the data voltage can be transmitted to the pixel electrode 11. When the data voltage is transmitted to the pixel electrode 11, the liquid crystal component 14 disposed between two substrates can obtain the desired voltage (i.e. the voltage difference between the pixel electrode 11 and the common electrode 13).

Additionally, the pixel circuit 10 further comprises a memory 15 to store the voltage of the liquid crystal component 14. The memory 15 can be a DRAM. Compared with an SRAM, the size of the DRAM is smaller than the SRAM. The memory 15 has a function, which stores the voltage of the liquid crystal component 14 when the switching element 12 is turned off. Since the memory 15 is a DRAM, a refreshing action is required to maintain the stored data.

In this embodiment, optical transmittance or reflectance of the liquid crystal component 14 is controlled according to the voltage transmitted by the switching element 12 and the stored data in the memory 15 such that the liquid crystal panel 16 displays images.

Figure 3:
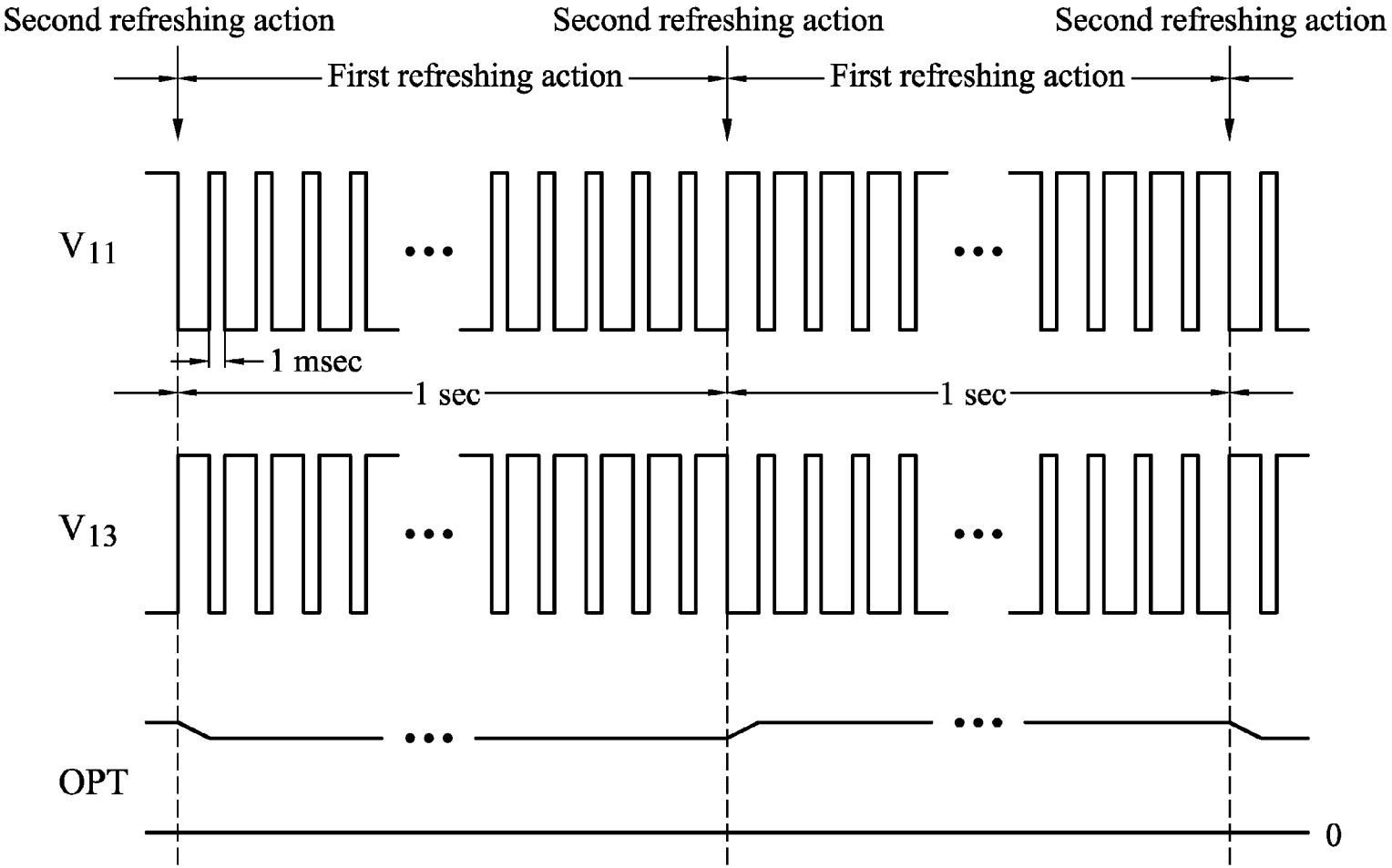
FIG. 3 is a timing diagram of an exemplary embodiment of a driving sequence.

FIG. 3 is a timing diagram of an exemplary embodiment of a driving sequence. The symbol $V_{11}$ represents pixel voltage of the pixel electrode 11. The symbol $V_{13}$ represents the common voltage of the common electrode 13. As shown in FIG. 3, during a predetermined time period, the pixel voltage $V_{11}$ and the common voltage $V_{13}$ are repeatedly performed by two continuous inversion operations with a timing interval in which the liquid crystal material does not react to changes. Assuming the reaction time of the liquid crystal component 14 is approximately 10 milliseconds and then the timing interval is approximately 1 millisecond. In other words, during a predetermined time period (e.g. 1 sec) of a first refreshing action, two refreshing operations are repeatedly executed and the two refreshing operations are executed with a timing interval (e.g. 1 millisecond).

Meanwhile, although two continuous inversion operations with a timing interval are performed to the pixel voltage $V_{11}$ and the common voltage $V_{13}$ as the first refreshing action, the disclosure is not limited thereto. In other embodiments, even amounts of continuous inversion operations with timing intervals may be performed to the pixel voltage $V_{11}$ and the common voltage $V_{13}$.

In an embodiment, one inversion operation is performed to the pixel voltage $V_{11}$ and the common voltage $V_{13}$ after the two continuous inversion operations with a timing interval performed to the pixel voltage $V_{11}$ and the common voltage $V_{13}$ are completed. In other words, the one inversion operation serves as a second refreshing action after the first refreshing action of two continuous inversion operations with a timing interval. During a current predetermined time period, the phases of the pixel voltage $V_{11}$ and the common voltage $V_{13}$ are reversed to the phases of the pixel voltage $V_{11}$ and the common voltage $V_{13}$ during a previous or a next predetermined time period. In this embodiment, the first and the second refreshing actions are repeatedly and alternately executed.

Meanwhile, although one inversion operation is performed to the pixel voltage $V_{11}$ and the common voltage $V_{13}$ as the second refreshing action, the disclosure is not limited thereto. In other embodiments, odd amounts of continuous inversion operations may be performed to the pixel voltage $V_{11}$ and the common voltage $V_{13}$.

As shown in FIG. 3, the symbol OPT represents optical transmittance (or reflectance) of the liquid crystal component 14. During one predetermined time period (i.e. executing the first refreshing action), the optical transmittance (or reflectance) of the liquid crystal component 14 is maintained at approximately one value. The value of the optical transmittance (or reflectance) of the liquid crystal component 14 however changes when the current predetermined time period is switched to the next predetermined time period. However, during the next predetermined time period, the value of the optical transmittance (or reflectance) of the liquid crystal component 14 is maintained at approximately the new value. With minimal changes in the value of the optical transmittance (or reflectance) of the liquid crystal component 14, noticeable flickers are reduced. Note that if the switching frequency is greater than 10 Hz, flickers are more noticeable. Thus, preferably, switching frequency is lower than 10 Hz.

The operating configuration of the liquid crystal display device is described in greater detail with reference to FIG. 3 and comparison to conventional operating configurations. In the conventional liquid crystal display device, each pixel does not comprise a memory. To reduce flickers, conventionally, the frame rate is set at 60 Hz, to write data into pixels. Thus, data is continuously provided to each pixel such that each bus line is repeatedly charged and discharged. If capacitance of a parasitical capacitor of one bus line is 10 pF~100 pF, power consumption thereof may equal 100 mW. Thus, it is hardly to reduce power consumption in the conventional liquid crystal display device, which comprises pixels and each pixel does not comprise a memory.

In an embodiment, the liquid crystal display device is a reflective liquid crystal display device. Since the reflective liquid crystal display device does not comprise a backlight, the reflective liquid crystal display device does not provide power to light the backlight. Additionally, each pixel circuit comprises a DRAM unit. Thus, the pixel circuit belongs to a memory in pixel (MIP) circuit. Since the DRAM unit stores data voltage when a switching element is turned off, data does not have to be continuously provided to a pixel such that each bus line does not have to be repeatedly charged and discharged and power consumption thereof can be reduced.

Further, in this embodiment, the DRAM unit stores the data voltage when the switching element is turned off. To maintain the stored data voltage, the DRAM is required to be refreshed. Because the DRAM unit is a digital memory, if a refreshing action is executed according to a preset period depending on a maintained high voltage, the DRAM unit can be refreshed. However, current leakage effect may be occurred in a pixel. Accordingly, the stored data voltage in the DRAM unit is reduced for analog.

Figure 4:
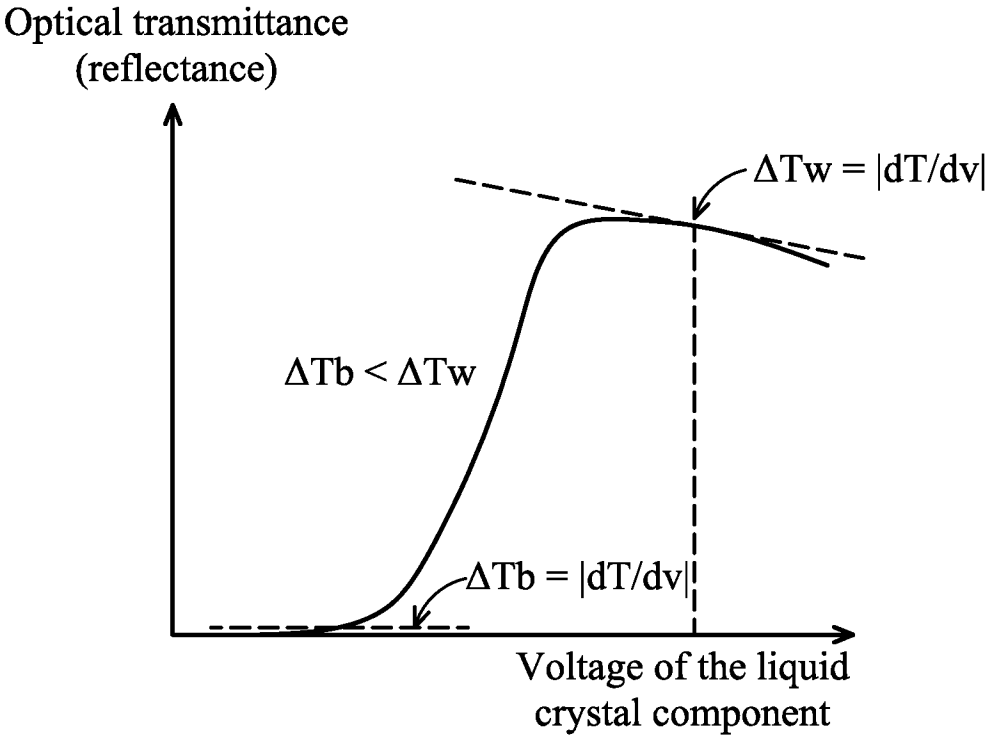
FIG. 4 shows a characteristic curve relating to a liquid crystal component and optical transmittance.

FIG. 4 shows a characteristic curve relating to a liquid crystal component and optical transmittance. The transverse axle represents the absolute value of the voltage provided to the liquid crystal component. The vertical axle represents the optical transmittance (or reflectance) of the liquid crystal component. As shown in FIG. 4, a non-linear curve is generated between the voltage provided to the liquid crystal component and the optical transmittance. This optical characteristic shown in FIG. 4 is easily sensed by viewer. Assuming current leakage occurs in a pixel, even if voltage falls in the DRAM units are small (e.g. 10 mV), noise or flicker is easily discovered by viewer.

Assuming a first pixel displays a white color and a second pixel displays a black color. In a normally black liquid crystal panel, flicker of the first pixel is more noticeable than that of the second pixel. In other words, if a partial differential operation is executed for the voltage provided to the liquid crystal component, the executed result ($\Delta Tw=|dT/dv|$) of the first pixel comprises a limited value and that ($\Delta Tb=|dT/dv|$) of the second pixel is approximately equal to zero. The optical transmittance of the first pixel displaying the white color is easily changed by the voltage provided to the liquid crystal component.

Figure 5:
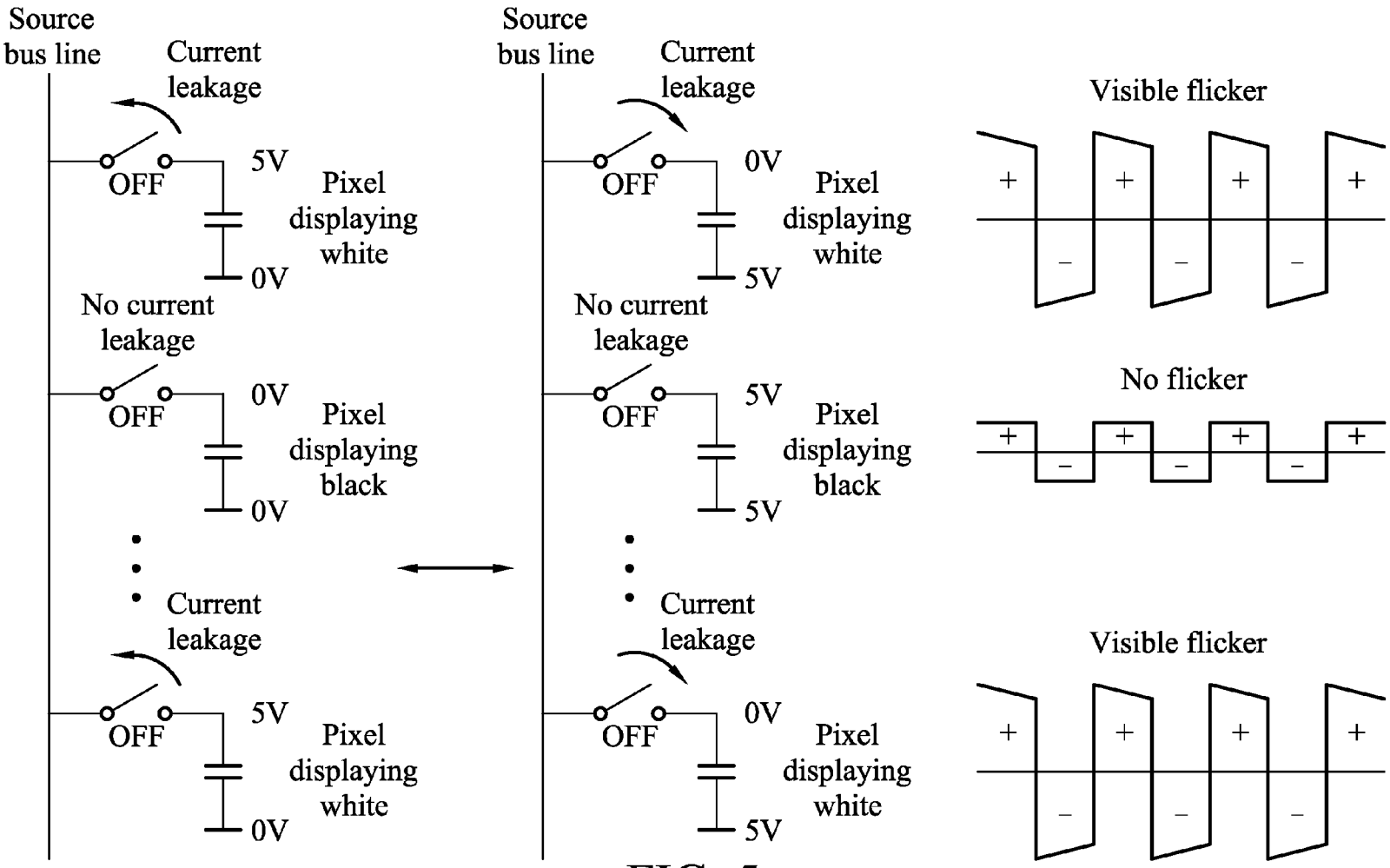
FIGS. 5 and 6 are schematic diagrams to describe flicker of first and second pixels.
Figure 6:
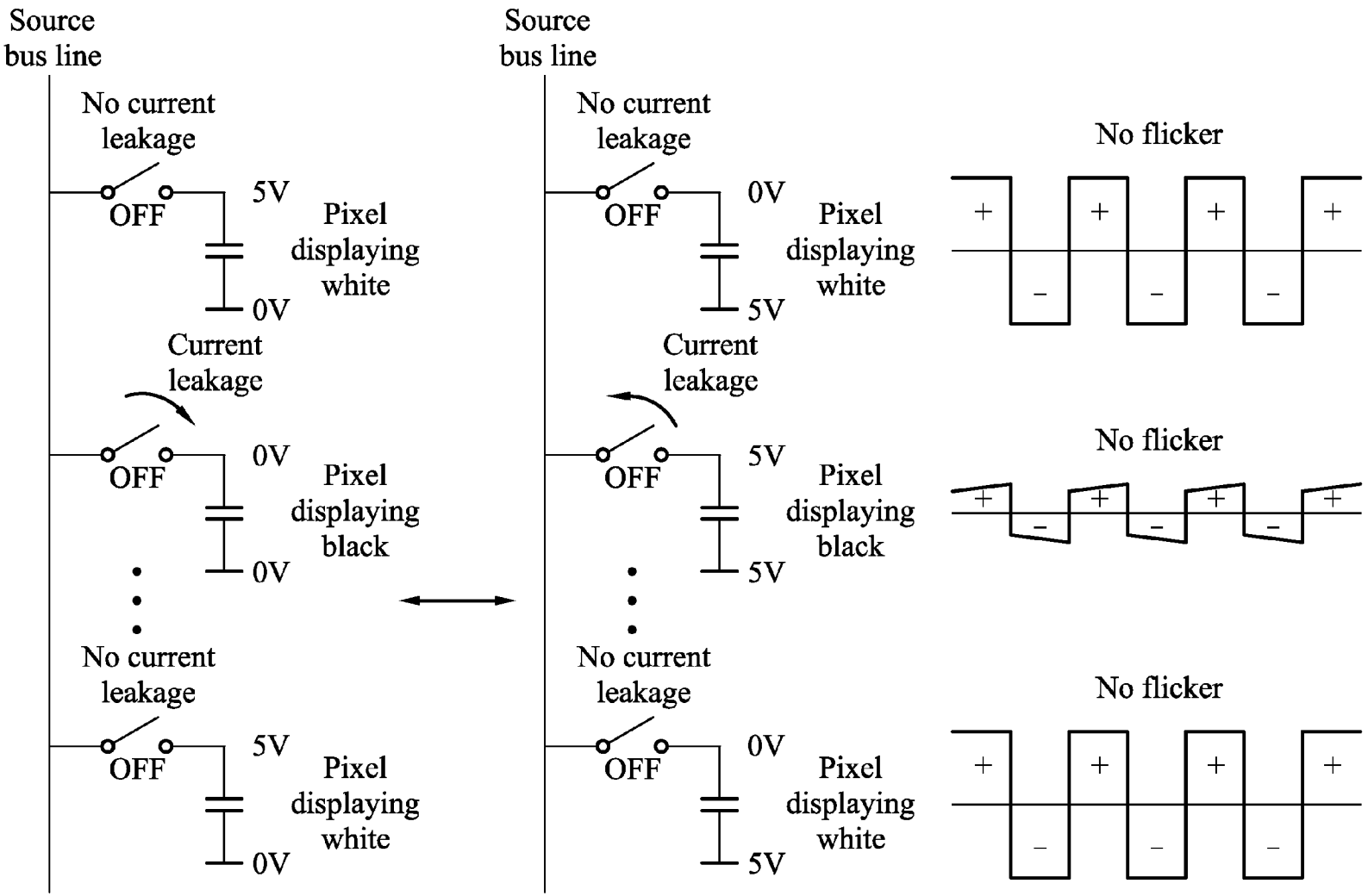

Note that the voltages of the source bus lines are the same as the voltages of the pixel electrodes to reduce flicker. Since the pixels in the same column are coupled to the same source bus line, when the voltage of the source bus line arrives at a common voltage, the current leakage of the second pixel displaying the black color is minimized but the current leakage of the first pixel displaying the white color is maximized. Additionally, when the voltage of the source bus line is equal to the voltage of the first pixel displaying the white color, current leakage of the first pixel is minimized but the current leakage of the second pixel displaying the black color is maximized. FIGS. 5 and 6 are schematic diagrams describing flicker of the first and the second pixels.

Even if the common voltage is adjusted, current leakage of the pixel displaying a black color and the pixel displaying a white color cannot be simultaneously reduced. For optical transmittance (or reflectance), when the pixel voltage is changed, the effect for the black pixel is lower than that for the white pixel. Thus, to reduce flicker, the voltage of the source bus line is maintained to equal a voltage level, which is equal to the voltage level of the first pixel when the first pixel displays the white color, as shown in FIG. 6.

Figure 7A:
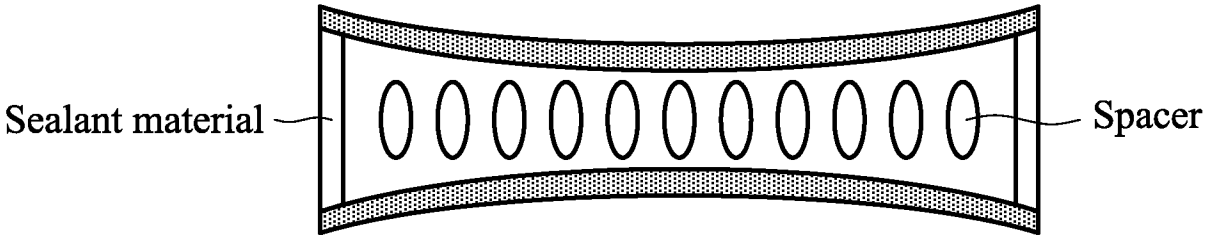
FIGS. 7*a* and 7*b* are cross sections of a liquid crystal panel.
Figure 7B:
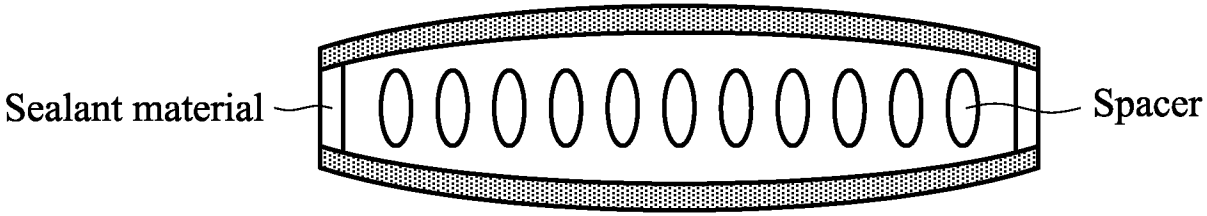

Although flicker is restrained, if the liquid crystal gap (or cell gap) of the display device is not uniform, flicker may be generated. FIGS. 7*a* and 7*b* are cross sections of a liquid crystal panel. The liquid crystal gap, which is the distance between two substrates (e.g. an array glass and a common electrode), is determined according to a spacer and a sealant material. Due to fabrication characteristics, the liquid crystal gap is not uniform. For example, the liquid crystal gap at the center portion of the liquid crystal panel is not equal to the liquid crystal gap at the peripheral portion of the liquid crystal panel. As shown in FIG. 7*a*, the liquid crystal gap at the center portion of the liquid crystal panel is narrower than the liquid crystal gap at the peripheral portion of the liquid crystal panel. As shown in FIG. 7*b*, the liquid crystal gap at the center portion of the liquid crystal panel is wider than the liquid crystal gap at the peripheral portion of the liquid crystal panel.

Note that each pixel comprises a memory, and the pixel voltage is influenced by feed through effect. Additionally, the liquid crystal gap is not uniform such that the equivalent capacitance of the pixel is changed according to the liquid crystal gap. Thus, when the equivalent capacitance of the pixel is changed, the feed through voltage between pixels is different.

Figure 8:
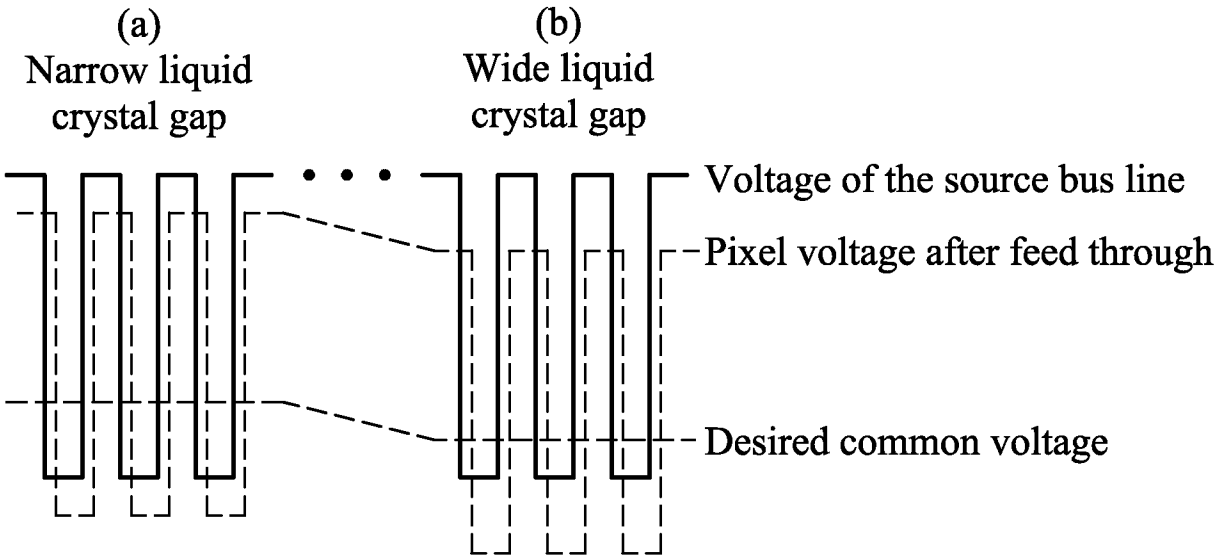
FIG. 8 is a schematic diagram of feed through voltage.

FIG. 8 is a schematic diagram of a feed through voltage. Referring to the left side of FIG. 8, when the liquid crystal gap is narrow, the equivalent capacitance of the pixel is higher. Thus, feed through effect is lower. Referring to the right side of FIG. 8, when the liquid crystal gap is wide, the equivalent capacitance of the pixel is lower. Thus, feed through effect is higher. Generally, the level of the common voltage is adjusted to compensate for the amplitude between the positive pixel voltage and the negative pixel voltage. However, the feed through voltage in the narrow liquid crystal gap differs from the feed through voltage in the wide liquid crystal gap due to the uniform liquid crystal gap. Thus, it is hard to obtain an appropriate common voltage for the narrow liquid crystal gap and the wide liquid crystal gap. For example, when the liquid crystal gap at the center portion of the liquid crystal panel is narrower than the liquid crystal gap at the peripheral portion of the liquid crystal panel (shown in the left side of FIG. 8), if the common voltage is adjusted according to the feed through voltage of the pixel disposed at the center portion, the feed through effect in the peripheral portion will not be reduced, and flicker will not be entirely eliminated. Thus, flicker at the center portion of the liquid crystal panel would be reduced, but flicker at the peripheral portion of the liquid crystal panel would be discovered.

For conventional display devices, to restrain flicker, the frame rate is high, at approximately 60 Hz. However, a MIP (memory in pixel) structure is utilized to reduce power consumption. Thus, if the frame rate of one display comprising the MIP structure is increased, power consumption is high.

In embodiments of the invention, a high frame rate is not utilized. Instead, the driving sequence as shown in FIG. 3 is utilized to restrain flicker, which is generated when the switching element 12 is turned off and the liquid crystal gap of the liquid crystal panel 106 is not uniform.

In embodiments of the invention, the frequency of refreshing the memory 15 storing the voltage of the liquid crystal component 14 is reduced along with power consumption of the liquid crystal display device.

Further, in this embodiment, the liquid crystal component 14 does not react to changes when the memory 15 is refreshed. Thus, a high frame rate, such as 60 Hz, does not have to be utilized to reduce flicker.

Additionally, when the same color (e.g. white) is displayed, if the phases of the pixel voltage and the common voltage are reversed during a cycle, image sticking effect can be avoided. During the cycle (e.g. longer than 1 second), the change between colors is hardly to be identified.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driving method for a liquid crystal display device comprising at least one pixel comprising a switching element, a liquid crystal component, and a memory, wherein the switching element is controlled to determine whether transmit a voltage to the liquid crystal component, and when the switching element is turned off, the memory stores the voltage to control optical transmittance or reflectance of the liquid crystal display device, comprising:

during a predetermined time period, executing a first refreshing action for the memory, wherein the first refreshing action repeatedly refreshes the memory by an even number of transitions with a timing interval in which the liquid crystal component does not react to changes;

after the predetermined time period, executing a second refreshing action, wherein the second refreshing action refreshes the memory by an odd number of transitions; and repeatedly and alternately executing the first and the second refreshing actions, wherein the liquid crystal component is disposed between a pixel electrode and a common electrode, and during the predetermined time period, a pixel voltage of the pixel electrode and a common voltage of the common electrode are repeatedly performed by even amounts of continuous inversion operations with the timing interval.

2. The driving method as claimed in claim 1, wherein the predetermined time period is longer than the time period for executing the second refreshing action.

3. The driving method as claimed in claim 1, wherein the predetermined time period is equals to 1 sec or longer than 1 sec.

4. The driving method as claimed in claim 1, wherein the time interval in which the liquid crystal component does not react to changes corresponds to a period in which no voltage difference is applied to the liquid crystal component.

5. The liquid crystal display device as claimed in claim 1, wherein the timing interval is less than reaction time of the liquid crystal component.

6. The liquid crystal display device as claimed in claim 5, wherein the timing interval is approximately 1 millisecond.

7. A liquid crystal display device, comprising:

a liquid crystal component, a switching element selectively transmitting a voltage to the liquid crystal component, wherein the voltage is transmitted to the liquid crystal component when the switching element is turned on, and the voltage is not transmitted to the liquid crystal component when the switching element is turned off;

a memory maintaining the voltage transmitted to control optical transmittance or reflectance of the liquid crystal display device when the switching element is turned off;

a repeating and alternating unit repeatedly and alternately executing a first refreshing action and a second refreshing action, wherein the first refreshing action repeatedly refreshes the memory by an even number of transitions with a timing interval in which the liquid crystal component does not react to changes, and the second refreshing action refreshes the memory by an odd number of transitions, wherein the liquid crystal component is disposed between a pixel electrode and a common electrode, and during the predetermined time period, a pixel voltage of the pixel electrode and a common voltage of the common electrode are repeatedly performed by even amounts of continuous inversion operations with the timing interval.

8. The liquid crystal display device as claimed in claim 7, wherein the predetermined time period is longer than the time period for executing the second refreshing action.

9. The liquid crystal display device as claimed in claim 8, wherein the predetermined time period is equals to 1 sec or longer than 1 sec.

10. The liquid crystal display device as claimed in claim 7, wherein the time interval in which the liquid crystal component does not react to changes corresponds to a period in which no net voltage difference applied to the liquid crystal component.

* * * * *